US010285250B2

(12) United States Patent
Alfier et al.

(10) Patent No.: US 10,285,250 B2
(45) Date of Patent: May 7, 2019

(54) METHOD OF CONTROLLING LIGHTING SOURCES, CORRESPONDING SYSTEM AND COMPUTER PROGRAM PRODUCT

(71) Applicants: OSRAM GmbH, Munich (DE); CLAY PAKY S.p.A., Seriate (IT)

(72) Inventors: Alberto Alfier, Vedelago (IT); Simone Capeleto, Padua (IT); Giovanni Zucchinali, Seriate (IT)

(73) Assignees: OSRAM GmbH, Munich (DE); CLAY PAKY S.P.A., Seriate (IT)

( * ) Notice: Subject to any disclaimer, the term of this patent is extended or adjusted under 35 U.S.C. 154(b) by 51 days.

(21) Appl. No.: 15/452,761

(22) Filed: Mar. 8, 2017

(65) Prior Publication Data

US 2017/0265270 A1 Sep. 14, 2017

(30) Foreign Application Priority Data

Mar. 9, 2016 (IT) ..... 102016000024679

(51) Int. Cl.
*H05B 37/02* (2006.01)

(52) U.S. Cl.
CPC ..... *H05B 37/029* (2013.01); *H05B 37/0245* (2013.01); *H05B 37/0272* (2013.01)

(58) Field of Classification Search
CPC ..... H05B 33/0845; H05B 33/0854; H05B 33/0857; H05B 33/0863; H05B 37/02; H05B 37/0272; H05B 37/0227; H05B 37/029; H05B 37/0281; H05B 37/0218; H05B 37/0236; H05B 37/0245; F21V 23/0442
USPC ..... 315/297, 307, 294, 312, 360, 308; 362/231, 227, 276; 340/4.3, 4.32
See application file for complete search history.

(56) References Cited

U.S. PATENT DOCUMENTS

| | | | | |
|---|---|---|---|---|
| 9,655,215 | B1 * | 5/2017 | Ho | H05B 37/0272 |
| 2012/0139417 | A1 * | 6/2012 | Mironichev | H05B 33/0842 315/86 |
| 2013/0198786 | A1 * | 8/2013 | Cook | H05B 37/0272 725/81 |

(Continued)

FOREIGN PATENT DOCUMENTS

WO 2011013035 A1 2/2011

OTHER PUBLICATIONS

Italian Search Report based on application No. IT UA20161494 (8 pages) dated Oct. 31, 2016.

*Primary Examiner* — Tung X Le
(74) *Attorney, Agent, or Firm* — Viering Jentschura & Partner MBB

(57) ABSTRACT

In various embodiments, lighting sources including at least one operating parameter, which is controllable in at least one lighting sequence as a function of a time code data set coupled with the sequence, are controlled by providing a repository of operating data files for the sources coupled with the lighting sources with each data file including at least one time code data set for at least one lighting sequence for a respective one of the lighting sources, by retrieving in the data repository at least one operating data file coupled with a selected one of the lighting sources, and by operating the selected lighting source by controlling the at least one operating parameter as a function of the operating data included in the operating data file retrieved.

11 Claims, 1 Drawing Sheet

(56) References Cited

U.S. PATENT DOCUMENTS

| | | | | |
|---|---|---|---|---|
| 2015/0091473 | A1* | 4/2015 | Clavenna, II ..... | H05B 37/0272 315/297 |
| 2016/0081166 | A1* | 3/2016 | Eddins ..... | H05B 37/0254 315/294 |

* cited by examiner

METHOD OF CONTROLLING LIGHTING SOURCES, CORRESPONDING SYSTEM AND COMPUTER PROGRAM PRODUCT

CROSS-REFERENCE TO RELATED APPLICATION

This application claims priority to Italian Patent Application Serial No. 102016000024679, which was filed Mar. 9, 2016, and is incorporated herein by reference in its entirety.

TECHNICAL FIELD

Various embodiments relate generally to lighting sources.

One or more embodiments may refer to both on a professional and on a non-professional level.

BACKGROUND

Light fixtures for professional applications (e.g. in the show business, such as theatres, cinemas, stages or discotheques) and for semi-professional applications (e.g. hotels, restaurants, meeting rooms), as well as for some non-professional environments (e.g. household or small meeting places) may impose specific needs which are not found in more common situations.

In such contexts, it may be desirable to fully take advantage of the potentialities of the lighting sources in ways different from current applications. For example, it may be desirable to modify the lighting features during a show, by acting on parameters such as light colour, light directionality, light distribution, light brightness etc.

Such an ability to modify lighting parameters may be of interest also for household applications, e.g. listening to music, watching a TV program or film, for web applications and e.g. for on-line videogames.

In current applications, when it is impossible or undesirable to resort to a wholly human control, audio sensors may be employed which are adapted to detect some characteristics of an audio program being broadcast (e.g. by sensing the bass sounds of drums), by associating such detection to specific interventions on the lighting sources.

This solution suffers from intrinsic limitations, both as regards the possible light combinations and as regards a possible creative/artistic usage of the lighting sources: an example may be the possibility of matching lighting in a given environment with a specific musical program/film/event and the flexible usage of lighting sources by the end user.

SUMMARY

One or more embodiments aim at overcoming the previously described drawbacks.

One or more embodiments relate to a method.

One or more embodiments may also concern a corresponding system, as well as a corresponding computer program product adapted to be loaded in the memory of at least one processing device, and including software code portions to execute the processing steps when the program is run on at least one computer. As used herein, the reference to such a computer program product corresponds to the reference to computer-readable media, which contain instructions to control the processing system in order to coordinate the implementation of the method according to the present disclosure. The reference to "at least one processing device" highlights the possibility of implementing one or more embodiments in a modular and/or distributed arrangement.

One or more embodiments may lead to the development of lighting systems, e.g. for show applications, which may offer professional performances while being user friendly.

One or more embodiments may lead to the implementation of a remotely-managed light show function, e.g. by a service provider. Moreover, no limitations are imposed on the achievable results, excluding e.g. the need of compromises in quality.

Moreover, the possible applications of one or more embodiments are not limited to the field of show/entertainment or to the professional sector: for example, one or more embodiments may be used for implementing light stimulation sequences in therapy techniques or in the use of videogames.

One or more embodiments may enable the detection of the lighting conditions of a given environment by the light radiation sources even when all the effect lights are off.

One or more embodiments may envisage the use of ITTT (If This Then That) techniques, e.g. for starting pre-programmed lighting sequences which may be used in a sport scenario, in order to highlight events in the game (e.g. scores).

One or more embodiments may allow different operators in different places to use one and the same program code for the same event (e.g. for music, as regards audio, or for video concerts) in such a way as to synchronize the corresponding lighting effects.

One or more embodiments may also adopt bio-feedback techniques, e.g. through sensor wristbands, in order to change e.g. the lighting of an event according to the viewers' feedback.

Moreover, one or more embodiments enable, when the same content is performed several times, to keep or modify (according to the user's choice or automatically) the related lighting effects.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

Figure 1:
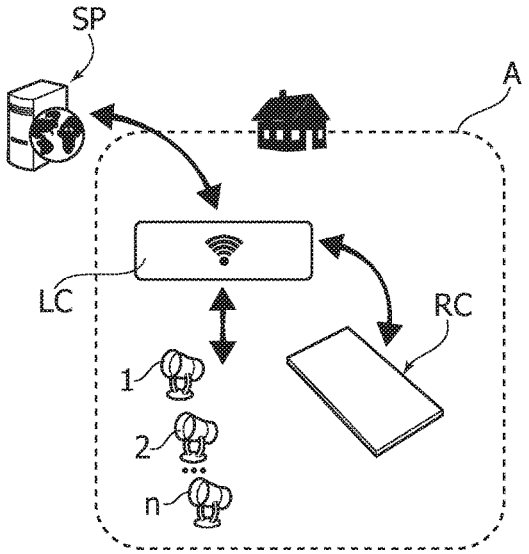
FIG. 1 is a first possible functional block diagram of a system according to one or more embodiments.

In the following description, various specific details are given to provide a thorough understanding of various exemplary embodiments. The embodiments may be practiced without one or several specific details, or with other methods, components, materials, etc. In other instances, well-known structures, materials, and operations are not shown or described in detail to avoid obscuring various aspects of the embodiments.

Reference throughout this specification to "one embodiment" or "an embodiment" means that a particular feature, structure, or characteristic described in connection with the embodiment is included in at least one embodiment. Thus, the possible appearances of the phrases "in one embodiment" or "in an embodiment" in various places throughout this specification are not necessarily all referring to the same embodiment. Furthermore, particular features, structures, or characteristics may be combined in any suitable manner in one or more embodiments.

The headings provided herein are for convenience only, and therefore do not interpret the extent of protection or scope of the embodiments.

In the Figures, references 1, 2, . . . , n denote a certain number of lighting fixtures, which may be the same or different from each other, and which may be installed in one or more environments, such as a general environment A.

As used herein, the term "environment" is to be construed in its broadest meaning, being adapted to include either a venue for shows and/or events (e.g. a theatre, a cinema, a stage, a discotheque, a sport facility etc.) or a public space (e.g. a hotel, a restaurant, a meeting room), or a home environment adapted to be lighted by sources 1, 2, . . . , n, which may be present in any number.

In one or more embodiments, the light radiation sources may be implemented with different technologies.

Moreover, it will be assumed herein that said lighting sources have at least one selectively controllable operating parameter.

Said operating parameter may be chosen in a very wide range: it may be e.g. the level of light brightness (which is controllable in on/off switching but also for a selective adjustment of intensity, so-called "dimming"), or the colour of the emitted light radiation, the orientation (both static, so-called "tilt", or dynamic, e.g. as regards the speed, the width or the path of a panoramic movement), the focus, the zoom (panoramic or spotlight) and so on: as a possible non-limiting reference, it is possible to take into account all the parameters which may be modified in order to implement lighting effects, optionally in combination with other effects (e.g. coloured smoke).

Light radiation sources having such option of selectively controlling at least one lighting parameter are known in the art, which makes it unnecessary to provide a more detailed description herein.

This also regards the possibility of controlling such parameters according to one or more lighting sequence, according to a time code data set adapted to identify, e.g., when a certain parameter of the light radiation source is to be modified. As a simple example (the idea being adapted to be transferred to any parameter regulating the operation of a lighting source) we may mention an on/off switching sequence of the source at given times, which identify the moments when the light radiation source is turned on or off.

Therefore, for each light radiation source 1, 2, . . . , n, it is possible to identify at least one operating parameter which may be controlled according to at least one lighting sequence, on the basis of a certain time code data set. Such control action may be exerted via a control device—known in itself—which will be named local controller LC in the following. The term "local" refers to the fact that such a controller may act locally (i.e. in environment A), in order to control the light radiation sources 1, 2, . . . , n correspondingly.

This may take place specifically via a computer program product (i.e. via software) offering the ability, via controller LC, to identify each single source 1, 2, . . . , n and to act on the respective operating parameters, according to software instructions adapted to be defined by the user during calibration.

For example, in one or more embodiments, the user may calibrate certain functions, e.g. according to the installation of the devices in environment A.

In one or more embodiments, such a calibration (i.e. a preparatory definition of the parameters which may be controlled, and of the way they may be controlled, for each source 1, 2, . . . , n) may also be carried out by the end user, via a remote controller RC which will be better detailed in the following.

In one or more embodiments, the software instructions may not be exactly defined at the beginning, the "free parameters" (undefined parameters) thereof being adapted to be set during calibration.

One or more embodiments may envisage providing, e.g. at a server SP (adapted to be located remotely from environment A, although such a solution is not mandatory), a repository of operating data of sources 1, 2, . . . , n.

In one or more embodiments, the files of such operating data may be organized in Data Packages (DPs) which are coupled, i.e. associated, to lighting sources 1, 2, . . . , n, in such a way that each data file DP may include at least one time code data set for at least one lighting sequence of a respective lighting source 1, 2, . . . , n.

The following Table exemplifies a possible organization of such Data Packages:

| Source No. | Lighting Sequence | Time Code Data Set |
|---|---|---|
| 1 | S11 | $t_{S11,1}, t_{S11,2}, \ldots, t_{S11,k}$ |
| 1 | S12 | $t_{S12,1}, t_{S12,2}, \ldots, t_{S12,l}$ |
| 2 | S21 | $t_{S21,1}, t_{S21,2}, \ldots, t_{S21,w}$ |
| 3 | S31 | $t_{S31,1}, t_{S31,2}, \ldots, t_{S31,u}$ |
| 3 | S32 | $t_{S32,1}, t_{S32,2}, \ldots, t_{S32,z}$ |
| 3 | S33 | $t_{S33,1}, t_{S33,2}, \ldots, t_{S33,m}$ |
| 3 | S34 | $t_{S34,1}, t_{S34,2}, \ldots, t_{S34,n}$ |
| . . . | . . . | . . . |
| N | Sn1 | $t_{Sn1,1}, t_{Sn1,2}, \ldots, t_{Sn1,v}$ |

In this table, Sij denotes the j-th sequence available for the i-th source, with the association of a respective time code data set $t_{Sij,1}, t_{Sij,2}, \ldots$.

As a deliberately simplified example, each sequence may be considered as simply identifying a sequence of on/off switching which must take place at the identified times of the related time code data $t_{Sij,1}, t_{Sij,2}, \ldots$.

In one or more embodiments, as exemplified in the Figures, server SP may be located remotely from environment A, and may be configured to communicate remotely with controller LC, with the ability of exchanging said Data Packages along a connection, e.g. a web connection such as the Internet.

Figure 2:
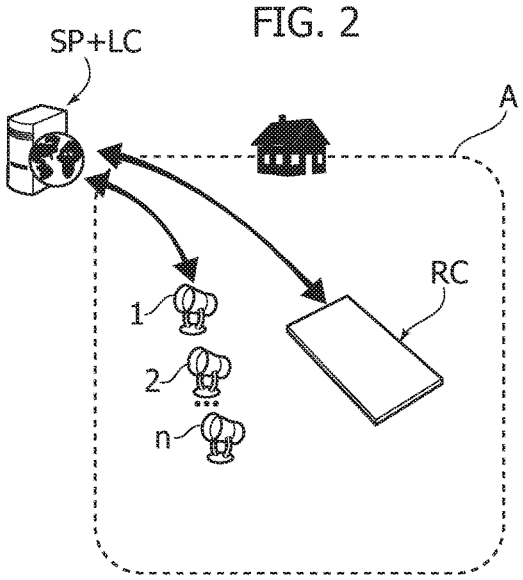
FIG. 2 is a second possible functional block diagram of a system according to one or more embodiments.
Figure 3:
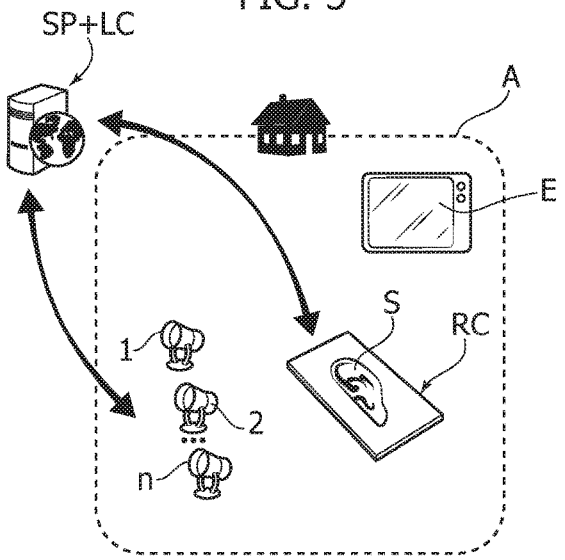
FIG. 3 is a third possible functional block diagram of a system according to one or more embodiments.

In one or more embodiments as exemplified in FIGS. 2 and 3, controller LC may be practically embedded in server SP, while keeping the role of "local" controller as defined in the foregoing.

Moreover, the ability is preserved to interact with sources 1, 2, . . . , n, so as to control the operating parameters thereof and/or to interact with remote controller RC, which may host the calibration software mentioned in the foregoing.

As regards the connection and the interaction between server SP, local controller LC and remote controller RC, different solutions may be resorted to as exemplified in the Figures.

Figure 4:
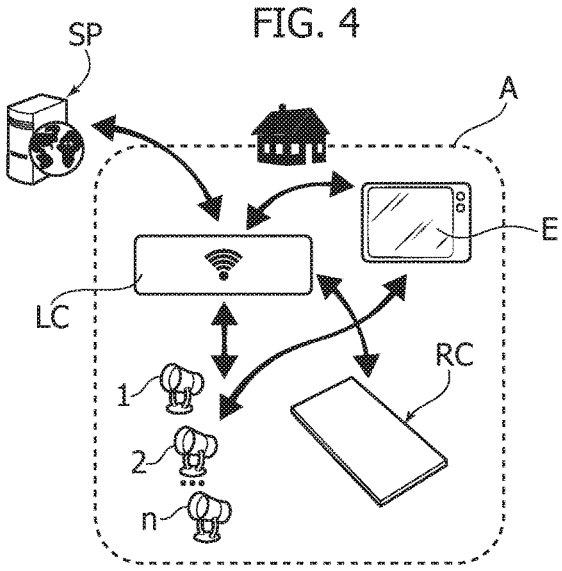
FIG. 4 is a fourth possible functional block diagram of a system according to one or more embodiments.

For example, FIGS. 1 and 4 refer to possible solutions wherein controller LC performs the role of a node, to which server SP, remote controller RC and sources 1, 2, . . . , n are connected.

On the other hand, FIGS. 2 and 3 exemplify solutions wherein, as controller LC is embedded in server SP, the assembly including server SP and controller LC is connected both with remote controller RC and with sources 1, 2, . . . , n.

As regards the specific implementations, the connections may be either wired or wireless, including either standard or specific data transmission protocols.

In one or more embodiments, controller LC and remote controller RC may be embedded in one device such as a smartphone, a smart TV set, specific devices such as a Set Top Box, or in a computer.

Moreover, in one or more embodiments the physical interaction with server SP may be limited to one of controller LC or remote controller RC; in this case, the component which is not connected to server SP (e.g. controller LC, or respectively remote controller RC) uses the connected device (i.e. remote controller RC or, respectively, controller LC) for transferring data towards server SP.

In embodiments as exemplified in FIGS. 2 and 3, lighting sources 1, 2, . . . , n may be connected directly to server SP, the functions of controller LC being practically embedded in server SP.

In such a case, remote controller RC may connect directly to server SP, e.g. via standard functions similar to those used on a smartphone or a tablet.

In one or more embodiments, local controller LC implements the communication of server SP with the fixtures 1, 2, . . . , n and with remote controller RC.

In one or more embodiments, as exemplified in FIGS. 2 and 3, the fixtures and the remote controller may be connected directly to the SP, without the need of a local controller LC as a separate entity. One example is a remote controller RC implemented as a smartphone, the sources including an IP address and a router.

In this case, the function of controller LC is practically "embedded", i.e. it is performed by such other entities.

It will be understood, therefore, that the reference to three separate entities, i.e. local controller LC, server SP and remote control RC is here merely functional and does not assume, even implicitly, the provision of such components as physically separated entities.

For example, in one or more embodiments as exemplified in FIGS. 2 and 3, the function of local controller LC which in FIGS. 1 and 4 is shown as performed by a discrete entity may be carried out directly by server SP.

Moreover, in one or more embodiments, the function of the local controller LC may serve to control a certain source or fixture 1, 2, . . . , n by forwarding a lighting sequence to such fixture once it has been obtained by the SP.

In one or more embodiments, server SP may contain a data repository (i.e. a database) including data files or Data Packages which may be selected e.g. by the end user via remote controller RC.

As described in the foregoing, in one or more embodiments each Data Package may include (at least):

one or more lighting sequences compatible with sources 1, 2, . . . , n installed in environment A, and one or more time code data sets associated, in server SP, to the lighting sequences.

In one or more embodiments (by acting e.g. on remote controller RC) the user may therefore select a given lighting sequence for a given source 1, 2, . . . , n, thus originating the retrieval, within the repository of server SP, of at least one Data Package coupled to the selected lighting source.

The thus identified Data Package may therefore be used to control the light radiation sources 1, 2, . . . , n according to the selected Data Package, i.e. by operating (each) selected light radiation source through the selective control of at least one operating parameter thereof, according to the operating data contained in the operating data file (Data Package) retrieved from the repository.

A system as exemplified herein may be used according to a wide range of possibilities.

For example, while he is following a given audio/video event (e.g. while he is watching a TV show or a film, while he is listening to a concert, etc.), the user may establish (e.g. via remote controller RC) a connection to server SP, and select one or more given lighting sequences which he wants to apply onto lighting sources 1, 2, . . . , n located in the environment A where he is at the moment.

Such a selection may be achieved, e.g., in the repository present in server SP, from a list of events which has previously been stored in server SP.

At this point, a lighting sequence which has been selected for a given source (more precisely, the Data Package associated thereto) may be used to operate that source according to that sequence, specifically as regards the time code data set.

In one or more embodiments, the related time code data set may enable synchronising the lighting sequence with the audio/video event on the basis of the user's request.

It will be appreciated that what has been said in the foregoing with reference to one source may be applied, even simultaneously, to two or more sources 1, 2, . . . , n.

For this purpose, one or more embodiments may take advantage of the fact that the configuration parameters of sources 1, 2, . . . , n may be standardized, being e.g. based on the same definition of parameters, thus enabling e.g. the definition of a standardized language linked to the operating parameters of the light radiation sources of a given manufacturer (who may know or own the control configuration).

For example, in one or more embodiments, the Data Packages collected in the repository of server SP may correspond to lighting sequences associated to specific events (e.g. given films, songs, shows), created and stored in the repository by:

either professional or amateur lighting directors, producers of music/video software, event organizers, producers, developers and distributors of the lighting sources.

In one or more embodiments, said Data Packages may be generated by the end user and then may be loaded into server SP by taking advantage of the existing connection with remote controller RC (optionally through controller LC), so as to confer the end user the role of an amateur lighting director.

In this regard, in one or more embodiments, a given lighting sequence may be stored in the sources 1, 2, . . . , n, e.g. as a pre-programmed function according to a basic operation.

As previously stated, the synchronization (phasing) of the lighting sequences of the repository of server SP may be achieved through the time code data sets associated to such sequences, which are implemented e.g. via a standard communication language which may be used by a broadcast source (web radio, web tv, web music).

In one or more embodiments, such a synchronising mechanism may involve the intervention of adaptive mechanisms.

Such mechanisms may be either open-loop or closed-loop mechanisms.

The first option may include, e.g., an (accurate) estimate and compensation of the possible delays between the audio/video program and the signals regulating the application of the lighting sequence, which may optionally be improved e.g. by "ping" tests.

In the second instance it is possible to use, as a loop control signal, an environment audio/video signal which corresponds to the broadcast program, e.g. via a TV set or monitor E or a similar device installed in environment A (see FIGS. 3 and 4).

Such an "environment" signal may be obtained via sensors (e.g. via an audio/video sensor S such a microphone associated with remote controller RC—which, as previously stated, may also be implemented via a smartphone, see FIG. 3) or via a direct connection e.g. to said device E (see FIG. 4).

However it may be obtained, said "environmental" audio and/or video signal may be used either directly or after further processing; the latter may be adapted to be performed, totally or partially, at a remote location, e.g. at server SP, the consequent possibility of using even rather powerful software tools.

In one or more embodiments, the availability of such information on the audio and/or video program broadcast in environment A may be used in order to drive the retrieval of the lighting sequence to be performed by sources 1, 2, . . . , n.

This may be the case e.g. if, for a given audio and/or video program, the repository of server SP offers several different lighting sequences.

In this case, in addition or in alternative to the selection by the final user (which can be expressed e.g. via remote controller RC), in one or more embodiments there may be present an automatic selection implemented in server SP, optionally on the basis of the previously collected information about e.g. the habits or the preferences of the end user.

In one or more embodiments (highlighting again the merely functional purpose of the distinction operated herein of controller LC, server SP and remote controller RC), both controller LC and remote controller RC may be used, at least partially, to store the repository of the Data Packages, e.g. if the connection to server SP is not available at the moment.

In one or more embodiments, a user input data set (e.g. parameters defined by the user such as e.g. the data concerning a certain media event, the names of given events, programming codes of live or recorded TV shows or sport events, or film titles, music titles, contents of playlists offered e.g. by an external service provider) may be loaded, optionally directly, into server SP while being associated with the Data Packages stored therein. Server SP, therefore, is adapted to determine lighting sequences e.g. on the basis of a further set of user input data (i.e. a specific lighting arrangement) so as to receive "tagged" Data Packages (both time-tagged and event-tagged) from server SP, which may control and operate in due time e.g. a set of lighting components (i.e. lighting sources 1, 2, . . . , n).

In one or more embodiments, the operating parameter(s) of lighting sources 1, 2, . . . , n may include e.g. brightness and colours, the consequent possibility being given of adjusting the lighting colour and brightness e.g. to take into account possible preferences or needs of the end user, e.g. to take into account the mesopic/scotopic sensitivity of the human eyes (and the differences in children and adults), the additional possibility being given of considering daltonism and sight disturbances of various nature.

As regards so-called "special effects", the controllable operating parameters may include parameters for underwater lighting effects or for light fountain effects, e.g. the possibility being given of regulating different colour shades to take into account and/or reproduce the absorbing effect of water.

As for the geometric parameters (such as the orientation of the light sources), optionally in combination with the selective control of parameters such as brightness, it is possible to take into account for example geometric factors (e.g. height or size) of environment A.

It will be appreciated, moreover, that in one or more embodiments the functional connection towards light radiation sources 1, 2, . . . , n does not necessarily require a physical connection, as it may be implemented as wireless, DMX or other methods.

As previously stated, programming codes (optionally encrypted) may be stored in sources 1, 2, . . . , n, in such a way as as to enable a selective control by entitled users.

A further possibility consists in using software code (e.g. an application or "App" for mobile phone, or TV, or web) on the local controller LC for selecting music (audio data, optionally associated with video data) from a distributor acting as a source, the data sequence being received together with the lighting sequence. The application may synchronize the data sets by sending them, e.g. via a local area network (LAN) (multicast and/or broadcast, for example) to connected devices, such as a TV set, an audio system, and the group of lighting sources 1, 2, . . . , n. A partial/total buffer may compensate for the delay and/or the slowness of the network.

One or more embodiments may adopt particular modes of encoding/decoding the data set of the lighting sequences.

For example, the data set may be encoded and loaded into server SP after or while programming a sequence, or at least at the end thereof.

For example, again, a data set coupled with a given selected lighting sequence may be decoded by the end user through a decoding algorithm, which may be:

either embedded in the lighting source(s), or embedded in one or more additional hardware devices, outside the sources, which decode the sequences and send them to the sources.

In one or more embodiments, the sources may be addressed individually by the decoder, either directly or by having the decoder address a source acting as a master, which subsequently transfers the sequence(s) to the other sources, acting as slaves.

It will be appreciated that various aspects of the solution may be transferred from one to another of the examples shown in FIGS. 1 to 4.

For example, in an arrangement as exemplified in FIG. 1, local controller LC may include a simple mobile phone with a given application (APP) installed therein.

In one or more embodiments, in order to achieve a protection against various intrusions (e.g. from competitors), the lighting sequences may be encoded with a protective encryption in server SP, a hardware decoder may be used (optionally a physical device embedded in a master source, which subsequently transfers the related information to the slave sources).

One or more embodiments may therefore envisage:

coupling respective audio and/or video data to the data files (Data Packages), and/or applying protective encoding to said data files, and/or coupling said data files to respective audio and/or video data, by applying protective coding to said files and to the respective audio and/or video data associated thereto.

In the case of videogames, the entitlement to creating the lighting sequences may be restricted to the game designers only, by enabling e.g. the calibration of the lighting arrangement via console, the sequences being stored in a repository at a server of the videogame publisher.

While the disclosure has been particularly shown and described with reference to specific embodiments, it should be understood by those skilled in the art that various changes in form and detail may be made therein without departing from the spirit and scope of the disclosure as defined by the appended claims. The scope of the disclosure is thus indicated by the appended claims and all changes which come within the meaning and range of equivalency of the claims are therefore intended to be embraced.

The invention claimed is:

1. A method of controlling lighting sources, said lighting sources comprising at least one operating parameter which is controllable in at least one lighting sequence as a function of a time code data set coupled therewith, the method comprising:

providing a repository of operating data files for said sources, said operating data files coupled with said lighting sources with each data file including at least one time code data set for at least one lighting sequence for a respective one of said lighting sources, retrieving in said data repository at least one operating data file coupled with a selected one of said lighting sources, operating said selected one of said lighting sources by controlling said at least one operating parameter as a function of the operating data included in the operating data file retrieved, arranging said operating data files in said repository in a plurality of subsets coupled with respective events in a list of events, whereby said at least one operating parameter is controllable as a function of a respective event selected in said list, detecting at said lighting sources at least one sound and/or video environment signal, and retrieving said at least one operating data file in said repository as a function of said environment signal, wherein detecting at least one sound and/or video environment signal comprises obtaining said at least one sound and/or video environment signal via at least one audio and/or video sensor.

2. The method of claim 1, further comprising:

coupling with said lighting sources, a controller, configurable for controlling said at least one operating parameter for said lighting sources, storing said repository of operating data files at a server, and transferring said operating data files between said server and said controller, wherein the at least one audio and/or video sensor is associated to the controller.

3. The method of claim 2, further comprising remotely controlling said controller either directly or via said server.

4. The method of claim 1, further comprising at least one of:

coupling with said data files respective audio and/or video data, and/or applying protective encoding to said data files, and/or coupling with said data files respective audio and/or video data, by applying protective encoding to said data files and the respective audio and/or video data coupled therewith.

5. The method of claim 1, further comprising:

detecting at said lighting sources at least one sound and/or video environment signal, and synchronizing said at least one operating data file retrieved with said at least one sound and/or video environment signal.

6. The method of claim 1, further comprising incorporating to said repository at least one user-generated operating data file.

7. The method of claim 1, wherein said at least one operating parameter is selected out of pan, tilt, on/off switching, dimming, colour and zoom.

8. The method of claim 1, further comprising:

arranging said operating data files in said repository in the plurality of subsets, wherein to an event in said list of events there are coupled a plurality of different subsets of said operating data files, and retrieving said at least one operating data file in said repository as a function of said environment signal in a selective manner between said plurality of different subsets coupled to said one event.

9. The method of claim 1, wherein said at least one audio and/or video sensor comprises a microphone.

10. A lighting system, comprising:

at least one lighting source having at least one operating parameter which is controllable in at least one lighting sequence as a function of a time code data set coupled therewith, a repository of operating data files for lighting sources wherein the repository is comprised of a plurality of subsets with respective events in a list of events, said operating data files coupled with a plurality of lighting sources with each data file including at least one time code data set for at least one lighting sequence for a respective one of said lighting sources, controlling means configured for:

retrieving in said repository at least one operating data file coupled with a selected one of said lighting sources, operating said selected lighting source by controlling said at least one operating parameter as a function of the operating data included in the operating data file retrieved, arranging said operating data files in said repository in the plurality of subsets coupled with respective events in a list of events, whereby said at least one operating parameter is controllable as a function of a respective event selected in said list, detecting at said lighting sources at least one sound and/or video environment signal, and retrieving said at least one operating data file in said repository as a function of said environment signal, wherein detecting at least one sound and/or video environment signal comprises obtaining said at least one sound and/or video environment signal via at least one audio and/or video sensor.

11. A computer program product embodied in a non-transitory computer readable medium including software code portions stored therein, the software code portions loadable in a memory of at least one computer and, and when executed by the at least one computer are configured to perform a method of controlling lighting sources, said lighting sources comprising at least one operating parameter which is controllable in at least one lighting sequence as a function of a time code data set coupled therewith, the method comprising:

providing a repository of operating data files for said sources, said operating data files coupled with said lighting sources with each data file including at least one time code data set for at least one lighting sequence for a respective one of said lighting sources, retrieving in said data repository at least one operating data file coupled with a selected one of said lighting sources, and operating said selected one of said lighting sources by controlling said at least one operating parameter as a function of the operating data included in the operating data file retrieved, arranging said operating data files in said repository in a plurality of subsets coupled with respective events in a list of events, whereby said at least one operating parameter is controllable as a function of a respective event selected in said list, detecting at said lighting sources at least one sound and/or video environment signal, and retrieving said at least one operating data file in said repository as a function of said environment signal, wherein detecting at least one sound and/or video environment signal comprises obtaining said at least one sound and/or video environment signal via at least one audio and/or video sensor.

* * * * *